US009598646B2

(12) United States Patent
Rinker et al.

(10) Patent No.: US 9,598,646 B2
(45) Date of Patent: Mar. 21, 2017

(54) PROCESS FOR TREATING COAL TO IMPROVE RECOVERY OF CONDENSABLE COAL DERIVED LIQUIDS

(71) Applicant: C2O Technologies, LLC, Marco Island, FL (US)

(72) Inventors: Franklin G. Rinker, Marco Island, FL (US); Timothy J. Kuhn, Toledo, OH (US)

(73) Assignee: C20 Technologies, LLC, Marco Island, FL (US)

( * ) Notice: Subject to any disclaimer, the term of this patent is extended or adjusted under 35 U.S.C. 154(b) by 69 days.

(21) Appl. No.: 14/151,385

(22) Filed: Jan. 9, 2014

(65) Prior Publication Data

US 2014/0190074 A1 Jul. 10, 2014

Related U.S. Application Data

(60) Provisional application No. 61/750,590, filed on Jan. 9, 2013.

(51) Int. Cl.
*C10L 5/14* (2006.01)
*C10L 5/02* (2006.01)
*C10G 5/06* (2006.01)

(52) U.S. Cl.
CPC ..... *C10G 5/06* (2013.01)

(58) Field of Classification Search
CPC ..... C10G 5/06; C08G 18/10; C08G 18/3237; C08K 9/08; Y10T 428/2998;
(Continued)

(56) References Cited

U.S. PATENT DOCUMENTS 1,538,490 A 5/1925 Randall
1,664,723 A 4/1928 Young
(Continued)

FOREIGN PATENT DOCUMENTS

CN 102199434 A 9/2011

OTHER PUBLICATIONS

Berkowitz N., An Introduction to Coal Technology, 1994, 2nd Edition, pp. 102-103; 164-165.
(Continued)

*Primary Examiner* — Latosha Hines
(74) *Attorney, Agent, or Firm* — MacMillan, Sobanski & Todd, LLC

(57) ABSTRACT

A method for treating coal includes drying coal in an initial drying step. The dried coal is pyrolyzed in a pyrolysis step to form coal char and evolved gases. The coal char is eventually cooled and blended. The evolved gases are condensed in at least two, preferably three or more, distinct zones at different temperatures to condense coal-derived liquids (CDLs) from the evolved coal gas. Noncondensable gases may be returned to the pyrolysis chamber as a heat-laden sweep gas, or further processed as a fuel stream. The CDLs may optionally be centrifuged and/or filtered or otherwise separated from remaining particulate coal sludge. The sludge may be combined with coal char, optionally for briquetting; while the CDLs are stored. Precise control of the condensing zone temperatures allows control of the amount and consistency of the condensate fractions collected.

20 Claims, 5 Drawing Sheets

(58) Field of Classification Search
CPC ..... Y10T 428/31511; Y10T 428/31551; Y10T 428/31721; Y10T 428/31725; Y10T 428/31786; Y10T 428/31931; Y10T 428/31935; Y10T 428/8305; G06F 9/5033; C06Q 10/06; H04L 65/1069; H04L 67/306; H04L 67/322; H04W 4/00; H04W 4/001; H04W 4/26; H04W 76/00; H04W 92/02
USPC ..... 208/340; 44/572, 591
See application file for complete search history.

(56) References Cited

U.S. PATENT DOCUMENTS

| | | | | |
|---|---|---|---|---|
| 1,669,023 | A | 5/1928 | Runge | |
| 1,814,980 | A | 7/1931 | Thomas | |
| 1,976,908 | A | 10/1934 | Wittenberg | |
| 2,029,883 | A | 2/1936 | MacCubbin et al. | |
| 2,040,100 | A | 5/1936 | Miller | |
| 2,044,764 | A | 6/1936 | Bywater | |
| 2,260,072 | A | 10/1941 | Wilton | |
| 2,366,900 | A | 1/1945 | Weir | |
| 2,528,553 | A | 11/1950 | Royster et al. | |
| 2,666,796 | A | 1/1954 | Gorin et al. | |
| 2,693,409 | A | 11/1954 | Stephens | |
| 2,748,063 | A | 5/1956 | Radasch | |
| 2,774,716 | A | 12/1956 | Kulik | |
| 3,010,893 | A | 11/1961 | Kulik | |
| 3,047,472 | A | 7/1962 | Gorin et al. | |
| 3,375,175 | A | 3/1968 | Eddinger et al. | |
| 3,463,310 | A | 8/1969 | Ergun et al. | |
| 3,574,065 | A | 4/1971 | Eddinger et al. | |
| 3,585,732 | A | 6/1971 | Itahashi | |
| 3,736,233 | A | 5/1973 | Sass et al. | |
| 3,938,966 | A | 2/1976 | Kindig et al. | |
| 4,017,272 | A * | 4/1977 | Anwer | C10J 3/54 201/31 |
| 4,028,219 | A | 6/1977 | Baldwin et al. | |
| 4,036,603 | A | 7/1977 | Bernet et al. | |
| 4,052,170 | A | 10/1977 | Yan | |
| 4,085,030 | A | 4/1978 | Green et al. | |
| 4,119,523 | A | 10/1978 | Baldwin et al. | |
| 4,146,367 | A | 3/1979 | Hsu | |
| 4,149,939 | A | 4/1979 | Solano | |
| 4,156,595 | A | 5/1979 | Scott et al. | |
| 4,213,826 | A | 7/1980 | Eddinger et al. | |
| 4,216,074 | A | 8/1980 | Simone | |
| 4,234,386 | A | 11/1980 | Stirling | |
| 4,263,124 | A | 4/1981 | Wickstrom et al. | |
| 4,322,222 | A | 3/1982 | Sass | |
| 4,341,598 | A | 7/1982 | Green | |
| 4,395,309 | A | 7/1983 | Esztergar | |
| 4,411,766 | A | 10/1983 | Garg et al. | |
| 4,411,767 | A | 10/1983 | Garg | |
| 4,466,362 | A | 8/1984 | Maxwell et al. | |
| 4,534,847 | A | 8/1985 | Roberts et al. | |
| 4,605,790 | A | 8/1986 | Wojtkowski | |
| 4,678,478 | A | 7/1987 | Kelland | |
| 4,834,650 | A | 5/1989 | Docherty et al. | |
| 5,017,283 | A | 5/1991 | Oder | |
| 5,087,269 | A | 2/1992 | Cha et al. | |
| 5,114,700 | A | 5/1992 | Meihack et al. | |
| 5,127,586 | A | 7/1992 | Oder | |
| 5,151,159 | A | 9/1992 | Wolfe et al. | |
| 5,171,406 | A | 12/1992 | Shang et al. | |
| 5,176,260 | A | 1/1993 | Oder | |
| 5,232,679 | A | 8/1993 | Jha et al. | |
| 5,240,592 | A | 8/1993 | Meyer et al. | |
| 5,326,457 | A | 7/1994 | Stipanovich, Jr. | |
| 5,372,497 | A | 12/1994 | Coolidge et al. | |
| 5,373,648 | A | 12/1994 | Wolf | |
| 5,401,364 | A | 3/1995 | Rinker | |
| 5,496,465 | A | 3/1996 | Fraas | |
| 5,547,549 | A | 8/1996 | Fraas | |
| 5,601,692 | A | 2/1997 | Rinker et al. | |
| 5,711,769 | A | 1/1998 | Rinker et al. | |
| 5,730,069 | A | 3/1998 | Coolidge et al. | |
| 5,997,289 | A | 12/1999 | Dover | |
| 8,366,882 | B2 | 2/2013 | Rinker | |
| 8,394,240 | B2 | 3/2013 | Rinker | |
| 8,470,134 | B2 | 6/2013 | Rinker | |
| 2003/0118962 | A1 | 6/2003 | Munzner et al. | |
| 2004/0065307 | A1 | 4/2004 | Fiveland et al. | |
| 2007/0272538 | A1 | 11/2007 | Satchell | |
| 2008/0006520 | A1 | 1/2008 | Badger et al. | |
| 2008/0116052 | A1 | 5/2008 | Eatough et al. | |
| 2008/0201980 | A1 | 8/2008 | Bullinger et al. | |
| 2009/0779981 | | 5/2009 | Drozd et al. | |
| 2009/0217574 | A1 | 9/2009 | Coleman et al. | |
| 2010/0000224 | A1* | 1/2010 | Cappello | C10K 1/028 60/780 |
| 2010/0223839 | A1 | 9/2010 | Garcia-Perez et al. | |
| 2011/0011719 | A1* | 1/2011 | Rinker | C10G 1/00 201/3 |
| 2011/0258914 | A1 | 10/2011 | Banasiak et al. | |
| 2012/0066967 | A1 | 3/2012 | Rinker | |
| 2013/0062186 | A1* | 3/2013 | Rinker | C10B 51/00 201/9 |

OTHER PUBLICATIONS

Dadayburjor, et al., Coal Conversion Processes Liquefaction, Kirk-Othmer Encyclopedia of Chemical Technology, 2003, vol. 6, pp. 851-856.
International Search Report and Written Opinion, PCT/US2010/041918, dated Feb. 24, 2011.
International Search Report and Written Opinion, Application No. PCT/US11/51927, Dated Mar. 27, 2012.
International Search Report, Application No. PCT/US2012/039598, Dated Dec. 28, 2012.
International Search Report and Written Opinion, PCT/US2014/010812, dated Apr. 16, 2014.
Kreith, F., Principles of Heat Transfer, 2nd Ed. 1965, pp. 236-238.
Mahajan O. et al., Low-temperature air oxidation of caking coals. 1. Effect on subsequent reactivity of chars produced, FUEL, 1980, vol. 59, January, pp. 3-10.
Oder, R., Dry magnetic Separation of Ash, Sulfur, and Mercury From a Southwestern Wyoming Coal, presented at the 18th International Low Rank Fuels Symposium, Jun. 24-26, 2003, Billings, Mt, pp. 1-6.
Written Opinion of the International Searching Authority, Application No. PCT/US2012/039598, Dated Dec. 28, 2012.
Chinese Office Action, Application No. 201480004337.8, dated May 26, 2016.

* cited by examiner

PROCESS FOR TREATING COAL TO IMPROVE RECOVERY OF CONDENSABLE COAL DERIVED LIQUIDS

RELATED APPLICATIONS

This application claims priority of provisional application 61/750,590 filed Jan. 9, 2013. This application is also related to published U.S. Patent Applications 2011/0011722, 2011/0011720, and 2011/0011719, each published Jan. 20, 2011; and to U.S. Patent Publication 2013/0062186, published Mar. 14, 2013, entitled PROCESS FOR TREATING COAL USING MULTIPLE DUAL ZONE STEPS.

The disclosures of all of the above patent publications and applications are incorporated herein by reference in their entirety. This invention was made with no U.S. Government support and the U.S. Government has no rights in this invention.

TECHNICAL FIELD

The present invention relates to the field of coal processing, and more specifically to a carbonization process for treating various types of coal for the production of higher value coal-derived products, such as coal char, coal liquids or oils, gaseous fuels, water and heat. More specifically, the present invention relates to processes and apparatus for the more efficient recovery of (1) coal-derived liquids (CDLs) from the gases driven off, and (2) the char produced from coal during pyrolysis. It is applicable to bituminous, subbituminous and non-agglomerating lignite ranks of coal.

BACKGROUND OF THE INVENTION

Coal in its virgin state is sometimes treated to improve its usefulness and thermal energy content. The treatment can include drying the coal and subjecting the coal to a pyrolysis process to drive off low boiling point organic compounds and heavier organic compounds. This thermal treatment of coal, also known as low temperature coal carbonization, causes the release of certain volatile hydrocarbon compounds having value for further refinement into liquid fuels and other coal-derived liquids (CDLs) and chemicals. Subsequently, the volatile components can be removed from the effluent or gases exiting the pyrolysis process. Such thermal or pyrolytic treatment of coal causes it to be transformed into coal char by virtue of the evolution of the coal volatiles and products of organic sulfur decomposition. The magnetic susceptibilities of inorganic sulfur and iron in the resultant char are initiated for subsequent removal of such undesirable components as coal ash, inorganic sulfur and mercury from the coal char.

It would be advantageous if agglomerating or bituminous coal could be treated in such a manner that would enable volatile components to be effectively removed from the coal at more desirable concentrations, thereby creating a coal char product having reduced organic sulfur and mercury. It would be further advantageous if bituminous coal could be refined in such a manner to create a second revenue stream (i.e., condensable coal liquids), which could be recovered to produce syncrude and other valuable coal products.

For example, even CDLs collected and separated may contain undesirable particulate matter—as much as 5-10% by weight by some estimates. These small, micron-sized particulates are generally undesirable, particularly if the CDL is to be further processed or refined by additional equipment. Therefore it would be advantageous to remove significant portions of these fine particulates.

SUMMARY OF THE INVENTION

In a broad aspect, a process for treating coal is described. The process builds on low temperature coal carbonization to separate coal into multiple components, including: coal char, coal-derived liquids (CDLs), and a gaseous fuel also known as syngas. The CDLs are further fractionated into multiple components in some embodiments. For example, in one aspect the invention is a method for treating effluent gases evolved from a coal pyrolysis process, the method comprising:

passing the evolved gases through at least two distinct condensation zones, each zone being maintained at a different temperature to condense to liquids the different boiling point fractions of the evolved gases;

(optionally) directing the liquids from each condensation zone to one or more separation units to separate particulate sludge and/or impurities from the condensed liquids; and directing the condensed liquids from each separation unit to its own separate storage tank, wherein the temperature of each condensing zone is controlled within a predetermined temperature range to collect a desired CDL fraction in each of the storage tanks.

In another aspect the invention is a method for treating effluent gases evolved from a coal pyrolysis process, the method comprising:

- drying coal to remove moisture;
- pyrolyzing dried coal in one or more pyrolysis chamber(s) to form coal char and evolved gases;
- passing the evolved gases through at least two, preferably three or more, distinct condensation zones of an absorber, each zone being maintained at a different temperature to condense to liquids the different boiling point fractions of the evolved gases;
- optionally directing the liquids from each condensation zone to one or more separation units to separate particulate sludge and/or impurities from the condensed liquids;
- directing the sludge (and particulates) separated from liquids at each separation unit to a common blending area with the coal char; and
- directing the condensed liquids from each separation unit to its own separate storage tank, wherein the temperature of each condensing zone is controlled within a predetermined temperature range to collect a desired fraction CDL in each of the storage tanks.

The methods may include further processing of any of the collected CDL, such as separation or purification by means such as centrifugation, filtration and the like. Particulates and sludge removed from the CDLs in these purification steps may be used in briquetting.

In other aspects the methods include further processing of the remaining gas stream after CDLs have been removed. For example, a portion of the gas stream may be re-cycled to the pyrolysis chamber(s) for use as a sweep gas to add direct heat. Another portion may be cooled to remove water vapor that remains and is stored as a dried gaseous fuel. Such a dried gaseous fuel has a high heating value, for example greater than 8,000 BTU/lb (20.4 MJ/kg). If being pumped long distances, it may be re-heated, for example to 50-70C, typically 55-65C, to reduce the likelihood of any components condensing in the conduits. The proportion for each such use can vary from 0 to 100%.

In another variation, the gas stream evolved from the absorber may be further processed with an electrostatic precipitator (ESP). The ESP can collect oil mist particles that are entrained in the stream and re-blend them with a light oil CDL fraction.

In a three zone absorber designed to collect and process CDLs from coal, the temperature set points for the three zones may include sequentially, from about 450F (232C) to about 550F (288C) for the heavy CDL fraction, from about 250F (121C) to about 400F (204C) for the middle CDL fraction, and from about 150F (65C) to about 250F (121C) for the light CDL fraction.

In another variation, the effluent gases from the pyrolysis process are first passed though a high temperature cyclone to remove char fines, and/or a venturi to mix and nucleate the heaviest condensable CDLs before they are admitted to the absorber. This step increases the capture of the desired CDL fraction in each zone by removal of nucleation sites for mist formation.

In another variation, any or all of the following fractions may be used as fuel and/or binder to form pellets or briquettes: the coal fines from the cyclone; the bottom bleeds from the highest temperature zone of the absorber; all or a portion of the heavy CDL fraction; all or a portion of the sludge and fines from optional purification of the CDLs.

Various other embodiments are described herein as well.

Various advantages of this invention will become apparent to those skilled in the art from the following detailed description of the preferred embodiment, when read in light of the accompanying drawings.

DETAILED DESCRIPTION OF THE INVENTION

The process pertains to treating non-agglomerating coal and various types of bituminous coal for the production of coal derived liquid (CDL) and other higher value coal derived products, such as a high calorific value, low volatile, low ash, low sulfur coal, also known as char, suitable for a variety of uses in industry, including metallurgical uses and power production, including forming the char into briquettes.

Figure 1:
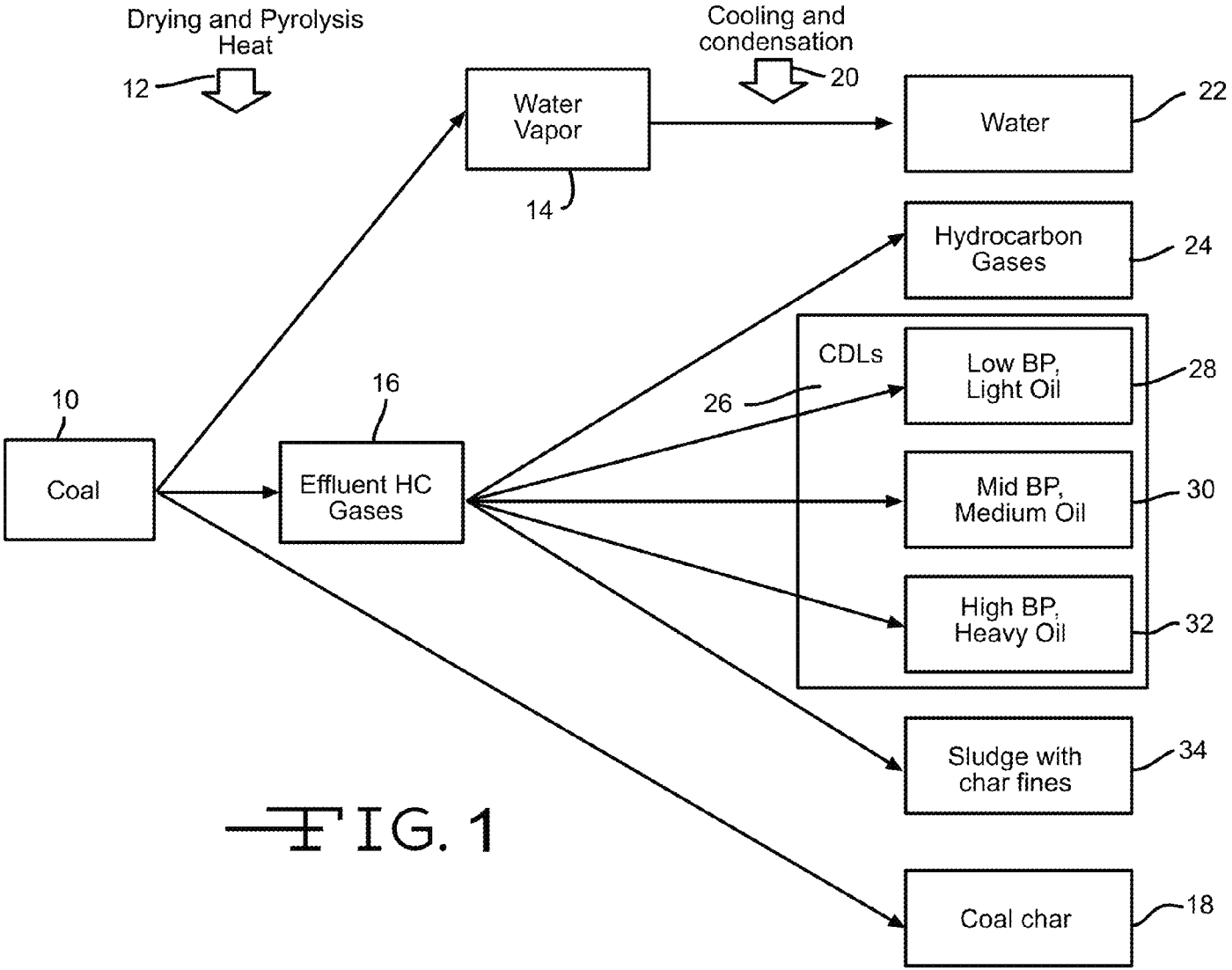
FIG. 1 is a generalized process diagram for a pyrolysis or carbonization process with multiple component fractions.

FIG. 1 illustrates the process at a very general level. Coal 10, is heated in one or more drying and/or pyrolysis steps which apply heat as indicated at 12. As noted above, this process is sometimes referred to as low-temperature carbonization. The pyrolysis process produces three products, water vapor 14, effluent or evolved gases 16, and coal char 18. These three products are cooled which, for gaseous products, leads to some condensation as indicated at 20. Water vapor 14 is condensed to water 22, and may be used for further processing steps. While the coal char 18 is one desirable product, the volatile effluent gases 16 from the coal may be refined to create a second revenue stream. The evolved or effluent gases include some gaseous components that will not condense at room temperature and these remain as hydrocarbon gases 24 or syngas, which is a third potential product and revenue stream. However, other components of the effluent gases 16 will condense and are referred to generically as coal-derived liquids or CDLs 26. According to the invention, CDLs 26 may be further fractionated into multiple components, such as low boiling point light oils 28, mid boiling point medium weight oils 30, and high boiling point heavy oils 32. Finally, the evolved gases may include char fines that may condense as a sludge 34. This general process is described in more detail below.

Figure 2A:
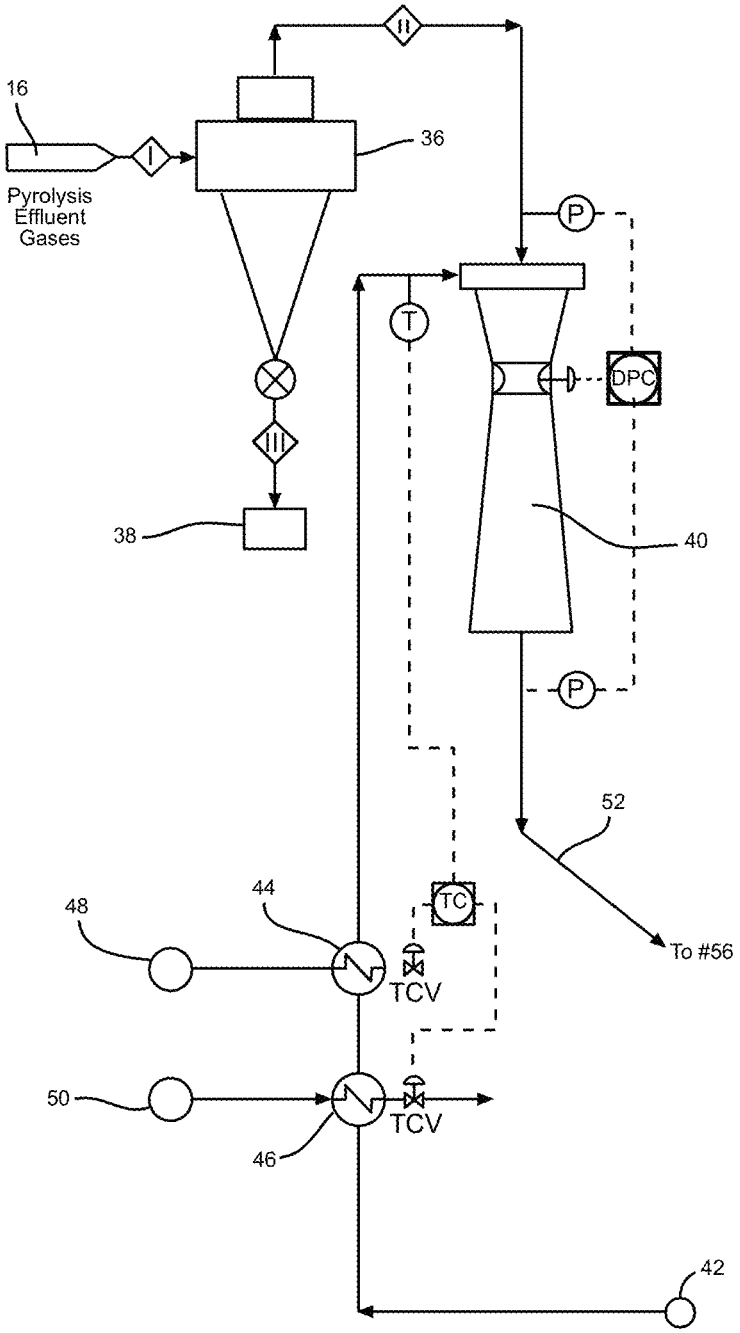
FIGS. 2A to 2C are sections of a schematic illustration of a process for treating the effluent gases formed by the pyrolysis of various types of bituminous coal.

FIG. 2 is a schematic illustration of a process for treating effluent gases 16 evolved from coal that has been pyrolyzed. FIG. 2 is divided into three sections, 2A, 2B and 2C, designed to be viewed as one large schematic. At various points, the lines from one section connect to lines of another section. Furthermore, at several points in the diagram a roman numeral inside a diamond indicates a particular process sampling point or location. These process sampling point locations coincide with those shown in Table B, which give some properties of the process stream at each particular location identified.

An optional drying step removes excessive moisture from the coal. The dried coal is then fed to a pyrolysis chamber where the coal is pyrolyzed as is known in the art at temperatures typically between about 500-600 C. Multiple pyrolysis stages may be used if desired. The pyrolysis is done with low oxygen and drives off impurities as evolved gases to improve the efficiency of the resulting coal as fuel, a process known as "beneficiation" of the coal.

Particle carryover in the effluent gas stream exiting from a pyrolysis chamber such as a fluidized bed has been estimated to be as high as about 15-20% by weight. These particles comprise char fines and quinoline insoluble particles. In one known example, these solids amounted to about 16.1% by weight. Consequently, the effluent gas stream may optionally pass through a high temperature, high efficiency cyclone separator 36 which separates out the carbon fine particulates 38. Solid particle loads can be reduced to as little as 1.0% by weight using such separators. Suitable cyclone separators are available from suppliers such as Ducon, 5 Penn Plaza, New York, N.Y.; Fisher-Klosterman, Louisville, Ky.; or Heumann Environmental, Jeffersonville, Ind. For example, some Heurmann units are designed to remove 95% of the minus 5 micron particulates carried in the pyrolysis effluent gas stream. The particulates 38 so removed from the effluent gas stream can be conveyed to a separate collection means or re-injected into the fluidized bed pyrolysis chamber. Preferably, the particulates 38 are transported from the separate collection means to be added downstream to the sludge and subsequently added to the coal char briquetting or shipped with the coal char in bulk form.

The evolved gases and any remaining particulates escaping the cyclone 36 are fed to the inlet of a variable throat venturi 40. During the condensation process, pure segmentation in fractionation is hampered by the formation of high boiling point (BP) mist or droplets which serve as nucleation sites, at which lower BP fractions may coalesce prematurely while still at high temperatures. It is desirable therefore, to separate remaining particulates and the high BP nucleates at an elevated temperature while the desirable lower boiling point hydrocarbon compounds are still vaporous. The venturi 40 may be operated from about 350C to 450C to remove these nucleates and cause forced nucleation of many of the high BP components. This may be followed by forcing the mist into the absorber 54 via a port 56 that is deliberately angled downwardly to the initial collection chamber 57 to prevent the high BP mist particles from continuing upward into the lower temperature condensing zones above. In testing, as much as 95% of the char fines and quinoline insoluble particulates were retained in with the high BP fraction in the lowest zone of the absorber 54.

The venturi 40 also serves to wet and mix the evolved gases. A source of fluid 42 may be heated or cooled as needed at heat exchangers 44, 46 fed by sources of heating fluid 48 or cooling fluid 50. The fluid source 42 is heated or cooled to a desired temperature (e.g. 350-500 C) in response to temperature sensor T, temperature control module TC, and temperature control valves TCV, and is then fed to the inlet of the venturi 40 to mix and wet the effluent gases 16. Pressure sensors, P, monitor the pressure above and below the throat of the venturi 40 and a pressure differential control module, DPC, adjusts the venturi throat to maintain a predetermined pressure differential. Such venturi devices suitable for use with the invention are available from: Sly, Inc., Strongsville, Ohio; Envitech, Inc. San Diego, Calif.; Monroe Environmental, Monroe, Mich.; and AirPol, Ramsey, N.J. The outlet of the venturi feeds line 52 which feeds the inlet of a quench tower or absorber 54 (See FIG. 2B).

The quench tower or absorber 54 condenses and separates volatile components from the evolved gases 16. According to an embodiment of the invention, the absorber 54 is divided into multiple condensation zones, i.e. two or more, preferably at least three zones. Referring to FIG. 2, three such condensation zones are shown, such as zones A, B and C, as identified by process sampling points IV, VI and VIII. These zones are maintained at increasingly lower temperatures as one progresses upward in the absorber tower. The three condensation zones result in heavy, mid and light CDL fractions being condensed and separated from the evolved gases. Additionally, a fine mist of additional light condensables may escape entrained in the gas stream, and may be processed as described below. While three such condensation zones are depicted, it will be understood that any number of multiple stage condensation zones is possible. The greater the number of condensation zones and the finer the temperature control in each one, the more uniform will be the condensed fractions resulting as the CDL components.

Other than the temperature at which each zone is set to condense, the structure of each is similar, so that only zone B is described in detail herein, it being understood that each such zone will have similar structures and function. Liquid condensed in zone B drains into a chimney tray 58. The chimney tray 58 allows gas to pass through a multiplicity of chimney ducts or tubes while collecting the liquid in the volumetric space above the tray and surrounding the chimney ducts. The condensed liquid is drawn away from the chimney tray 58 by means of a pump 60, optionally through a valve 62 and strainer 64. A level meter L and a level control LC maintain the draw rate so as maintain a minimal threshold level at the bottom of zone B. The withdrawn liquid is carried to a heat exchanger 68 where it transfers its heat to a coolant fluid that is pumped through the heat exchanger 68 from a source 70 and to which it may return in a loop. A temperature sensor T monitors the temperature of the liquid exiting the heat exchanger 68 and temperature controller TC controls the temperature control valve TCV to control the flow of coolant to the heat exchanger 68.

A portion of the cooled fluid exiting the heat exchanger 68 is diverted back to the top of zone B and to sprayers 72 which spray the liquid onto the hot gases to initiate further condensation, thus completing the loop. A flow meter F and flow control FC control the flow control valve FCV to maintain a constant flow rate to the sprayers 72. The remainder of the cooled fluid exiting the heat exchanger 68 (process sampling point VII) is carried to an optional separator, such as centrifuge 74, for further processing that will be described momentarily.

Zones A and C have similar liquid sprayer loops that are cooled by heat exchangers and aid in condensation. These heat exchangers are conventional in using a coolant fluid to exchange heat with the hot gases thereby cooling them to condense the volatile components with boiling points below the target temperature range, while not condensing volatile components with lower boiling points. Thus, the temperature set points for zones A, B, and C are all likely to be different, however, with the set point decreasing in succession from A to C. Typical temperature ranges for a three zone absorber are discussed below. The excess condensed liquid from Zone A (process sampling point V) is carried to an optional separator, such as centrifuge 76, and the excess condensed liquid from Zone C (process sampling point IX) is carried to an optional separator, such as centrifuge 78. Also, bottoms may be bled from the strainer below Zone A, to combine with sludge and/or use as a binder in a subsequent pelleting or briquetting operation.

Figure 2B:
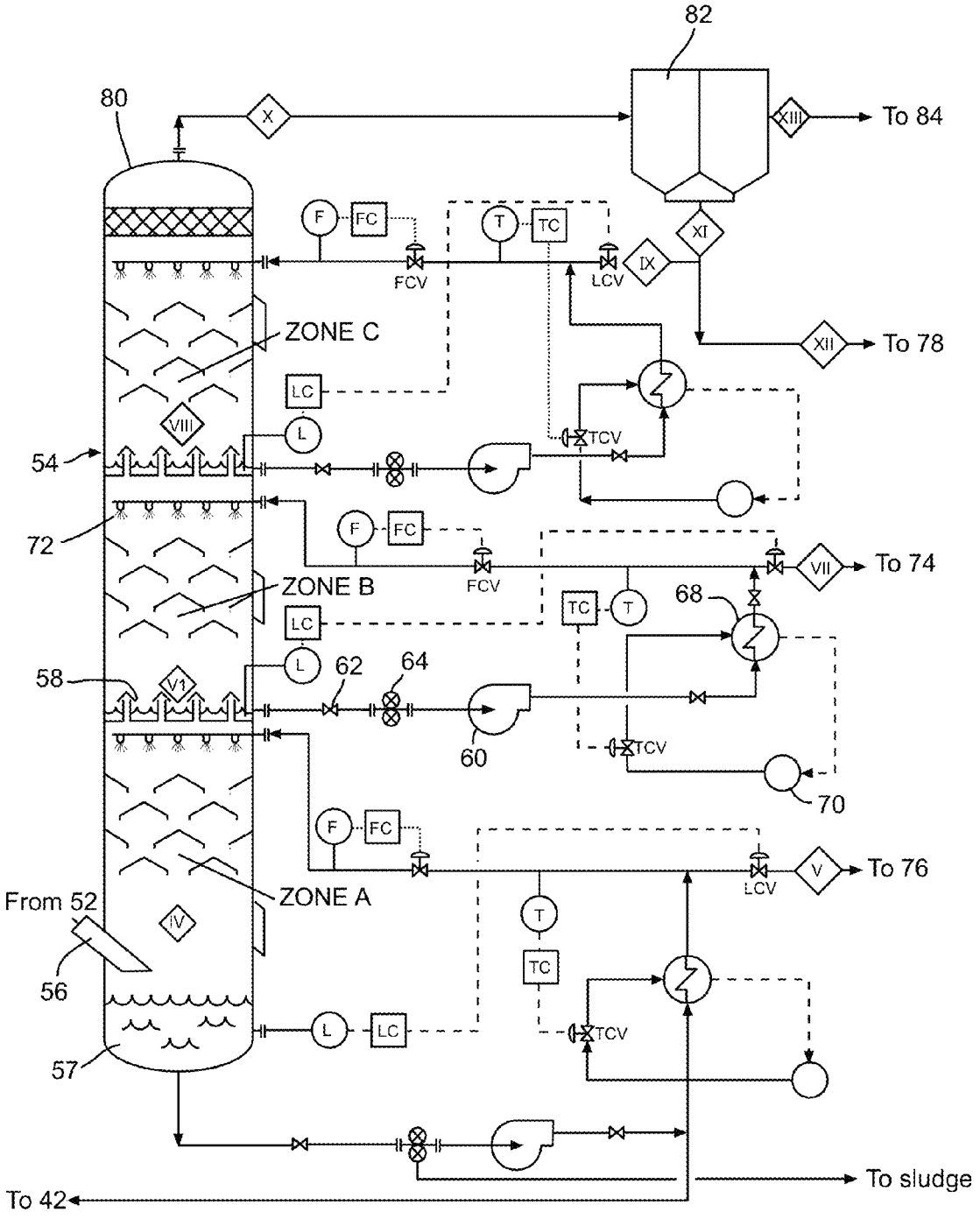

Although shown as a loop configuration in FIG. 2B, heat from the heat-exchanged coolant may optionally be recovered in a heat recovery area to be used for other heating needs such as, for example, a sweep gas, a warmer or dryer, or any other process step requiring the input of heat.

Within each zone at the temperature (or range) of its set point, a certain fraction of the volatiles condense depending on their boiling points and vapor pressure within the mixture. Assuming a light CDL loop target temperature in Zone C of about 77 C+/−5, as shown in the schematic of FIG. 2, a certain percentage of the condensable evolved gases remain as a mist of fine droplets in the gas stream. This mist evolves from the absorber at the top 80 (process sampling point X) and may be fed to a gas cleaning unit or particle separator, such as a wet electrostatic precipitator (ESP) 82, which is used in the gas cleaning area to separate the mist droplets from the gas stream. The mist droplets contain additional light CDL and may be combined with previously fractionated light CDL as shown in FIG. 2 (process sampling point XI). Suitable ESPs are available from Lodge (KC) Cottrell, Inc., The Woodlands, Tex.; and/or Hamon Research-Cottrell, Inc., Somerville, N.J.

Suitable absorbers or quench towers are assembled from parts made by commercial suppliers such as Koch-Glitsch, LP, Wichita, Kans.; Sulzer Chemtech USA, Inc., Tulsa, Okla.; Raschig-Jaeger Products, Inc., Houston, Tex.; and others.

The gas stream leaving the precipitator 82 often contains traces of condensable hydrocarbon compounds and typically 20 to 30 weight % uncondensed moisture, the temperature typically at about 75 to 85C. For use as a fuel, it is desirable to remove some or most of the moisture and thereafter to reheat the gas to eliminate further condensation of either hydrocarbon compounds or water. Carryover of water is undesirable in the fuel as it lowers the calorific heating value of the fuel gas. Carryover of traces of condensable hydrocarbons which may condense in long gaseous fuel delivery conduits causing buildup and reduced flow path en-route to the fuel point of use is undesirable. Accordingly, the gas stream is then carried to a cooler 84 (FIG. 2C) where it is cooled to about 50 C in order to remove any water vapor that may remain. Water collects in a sump 86 (process sampling point XVI) and may be waste or used for other purposes.

The noncondensable gas that exits the cooler 84 is known as syngas or gaseous fuel and generally is composed of hydrogen, carbon oxides, water, and $C_6$ or shorter hydrocarbons. Table C (Below) lists many of these components. This process gas is sometimes burned off as flame, but may also be an important product gas itself. Optionally, this gas is reheated by a heat exchanger 88 to avoid condensation in long pipelines, and pumped by fan 90 to storage or to a location for further use, such as a fuel. The process gas may flow at typical rate of 6,000 to 10,000 kg/hour and may be reheated to about 60 C prior to being piped to a gas user.

In an important variation, a portion of the gas stream may be taken from a split point directly after the electrostatic precipitator 82 (process sampling point XIV) and pumped by fan 92 to the pyrolysis chamber(s) for use as a sweep gas without cooling. From 0% to 100% of the gas stream may be used for pyrolysis sweep gas, more typically from 40% to about 80%. If any portion of the gas stream is desired for pyrolysis, it is more energy efficient to bypass the cooler 84 and re-heater 88.

Depending on the type of coal and pyrolysis conditions, a typical three condensation zone absorber may be designed and configured to condense about 20% (+/−5%) heavy CDL fraction, about 25% (+/−5%) mid CDL fraction and about 20% (+/−5%) light CDL fraction in the three condensation loops as shown in FIG. 2. An additional 35% (+/−10%) by weight of light CDL condensables may exist in the mist droplets that escape to the electrostatic precipitator 82 which, when combined with the other light CDL fraction, yields about 55% of the total condensable portion.

Figure 2C:
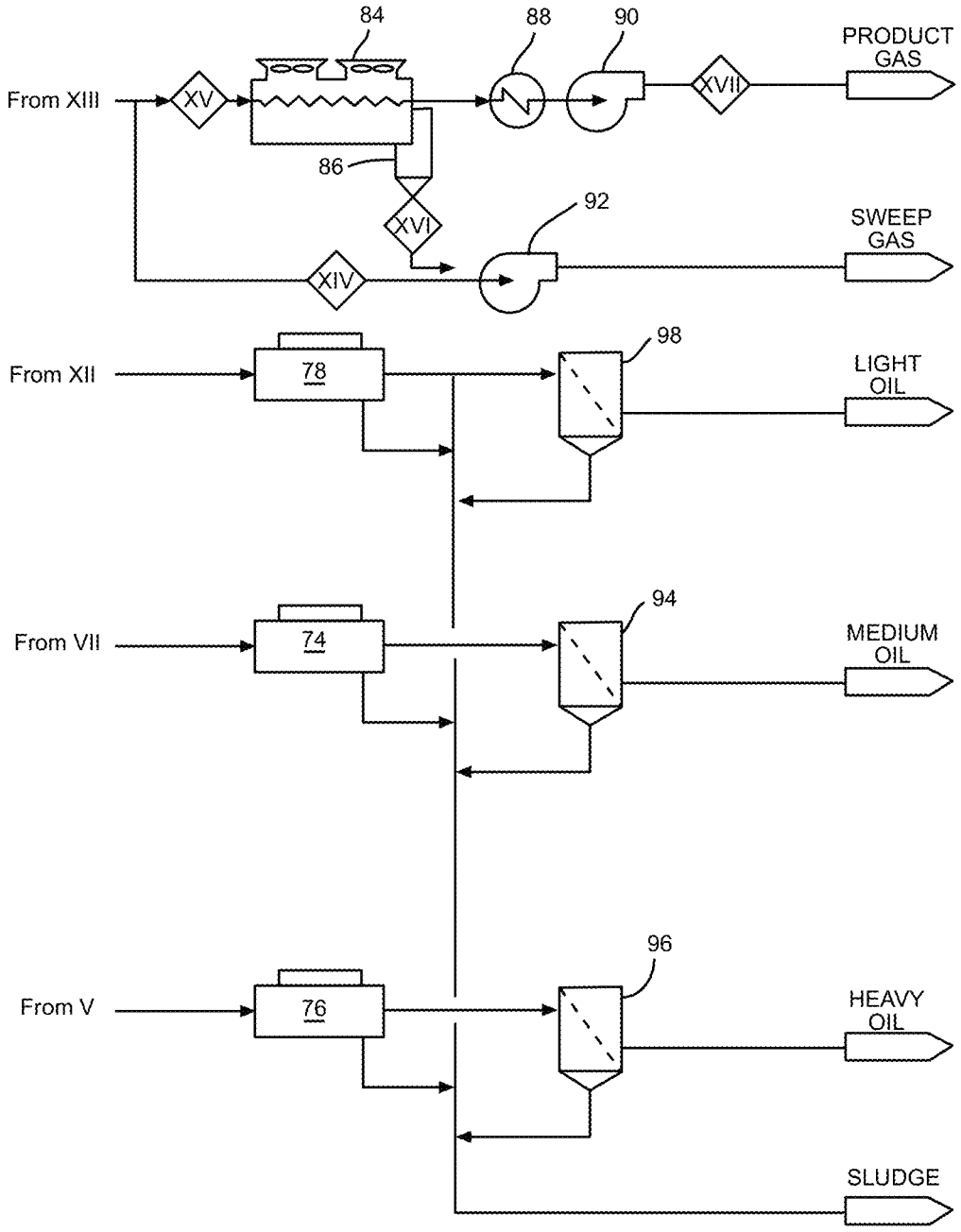

As previously noted, the CDL condensed in Zone B is led to a centrifuge 74 (FIG. 2C). More generally, the condensed CDLs form each condensation zone may be further purified, filtered or separated to remove unwanted components. Separations may include any one or more of centrifuges, cyclone separators, ultra-high efficiency cyclones, electrostatic precipitators (ESP), drop boxes, filters of suitable pore size, etc. to remove fine particulates. Suitable centrifuges are commercially available from Flottweg, North America, Independence, Ky.; GEA Westfalia Separator Group, Northvale, N.J.; and Haus Centrifuge Technologies, (Welco Expediting, LTD) Calgary, Alberta, Calif., among others. Suitable filters are commercially available from, for example, Towner Filtration, Twinsburg, Ohio.

In one embodiment, the heavy CDLs are led to centrifuge 76 and the supernatant CDL portion may further be passed through a filter 96. These optional separation steps further purify the heavy CDLs, removing sludge and particulates. Similarly, medium CDLs are led to centrifuge 74 and the supernatant CDL portion may further be passed through a filter 94. These optional separation steps further purify the medium CDLs, removing sludge and particulates. Finally, light CDLs are led to centrifuge 78 and the supernatant CDL portion may further be passed through a filter 98. These optional separation steps further purify the light CDLs, removing sludge and particulates. The sludge and particulates from each of the three centrifugation and three filtration steps may be combined and used elsewhere, for example in briquetting processes.

Even though we refer to fractions as high, medium and low BP fractions, it is well understood that there is a distinction between boiling points (BP) and the actual temperature at which the condensable components will condense. Each condensable component "boils" at the temperature at which its pure vapor pressure equals atmospheric pressure. In contrast, the fractional condensation temperature (FCT) takes into account the fact that these compounds are in mixtures and each exerts only a partial vapor pressure—they are not pure. The fractional condensation curve table below (Table A) correlates the condensation zone target temperature with the approximate percent (by weight) of the CDL fraction that will condense under typical conditions, making certain assumptions about the partial pressure level of condensable components vs. the non-condensable components. Component-specific FCT estimates are discussed below in connection with FIG. 3.

TABLE A

Fractional Condensation Temperatures (FCT)

| Temp (F.) | Temp (C.) | Condensation Curve, assuming 100% condensables | Estimated Condensation Curve, assuming 25% condensables |
|---|---|---|---|
| 995 | 535 | 0% | 0% |
| 937 | 502.8 | 5% | |
| 885 | 473.9 | 10% | |
| 849 | 453.9 | 15% | |
| 822 | 438.9 | 20% | 5% |
| 794 | 423.3 | 25% | |
| 766 | 407.8 | 30% | |
| 738 | 392.2 | 35% | |
| 715 | 379.4 | 40% | |
| 687 | 363.9 | 45% | 10% |
| 685 | 362.8 | | |
| 658 | 347.8 | 50% | |
| 629 | 331.7 | 55% | |
| 601 | 316.1 | 60% | |
| 595 | 312.8 | | 15% |
| 572 | 300 | 65% | |
| 541 | 282.8 | 70% | |
| 512 | 266.7 | 75% | |
| 495 | 257.2 | | 20% |
| 483 | 250.6 | 80% | |
| 449 | 231.7 | 85% | |
| 420 | 215.6 | | 30% |
| 414 | 212.2 | 90% | |
| 369 | 187.2 | 95% | |
| 350 | 176.7 | | 40% |
| 300 | 148.9 | | 50% |
| 270 | 132.2 | 100% | |
| 260 | 126.7 | | 60% |
| 230 | 110 | | 70% |
| 200 | 93.3 | | 80% |
| 160 | 71.1 | | 100% |

In selecting a target temperature for each zone, it should be recalled that all volatile components having a fractional condensation temperature (FCT) above the target temperature for the particular zone are likely to condense in that zone. Thus, tradeoff decisions are to be made about how many fractions are desired and how fine or broad a temperature window is needed for capturing that entire component without undue impurities. These are traded off against the cost and efficiency of additional condensation loops, and the desire and ability to further refine the fractions as collected. It should be understood that the target temperature to maintain in the condensation loops will typically be at the lower end of the ranges described herein, in order to recover all condensable components in the desired fraction.

For example, in a three loop condensation zone process as described in FIG. 2, the temperature may be set to collect three fractions in the condensation loops—heavy, middle and light fractions—having respectively approximately 20%, 25% and 20-25% by weight of the condensable components. Another 30-35% light CDL found in the entrained mist may be precipitated and combined with the 20-25% from the exchange loop. With these assumptions, the heavy fraction target might be set at a temperature from about 450 F (232C) to about 550F (288C), preferably about from about 470F (243C) to about 530 F (278C). The middle fraction target might be set at a temperature from about 250F (121C) to about 400F (204C), preferably about from about 250F (121C) to about 350F (177C). The light fraction target might be set at a temperature from about 150F (65C) to about 250F (121C), preferably about from about 160F (71C) to about 220F (105C).

It will be understood that a desire to collect additional fractions will require additional target temperatures determined according to similar logic, but with narrower temperature windows. Similarly, a desire to collect fractions that are smaller or larger than the assumed 20% heavy, 25% mid, 20% light CDLs (plus 35% additional light CDL in the mist) will require adjustments to the target temperatures as well, based on theoretical BP curves modified to fit the altered assumptions, or on empirical experience.

Figure 3:
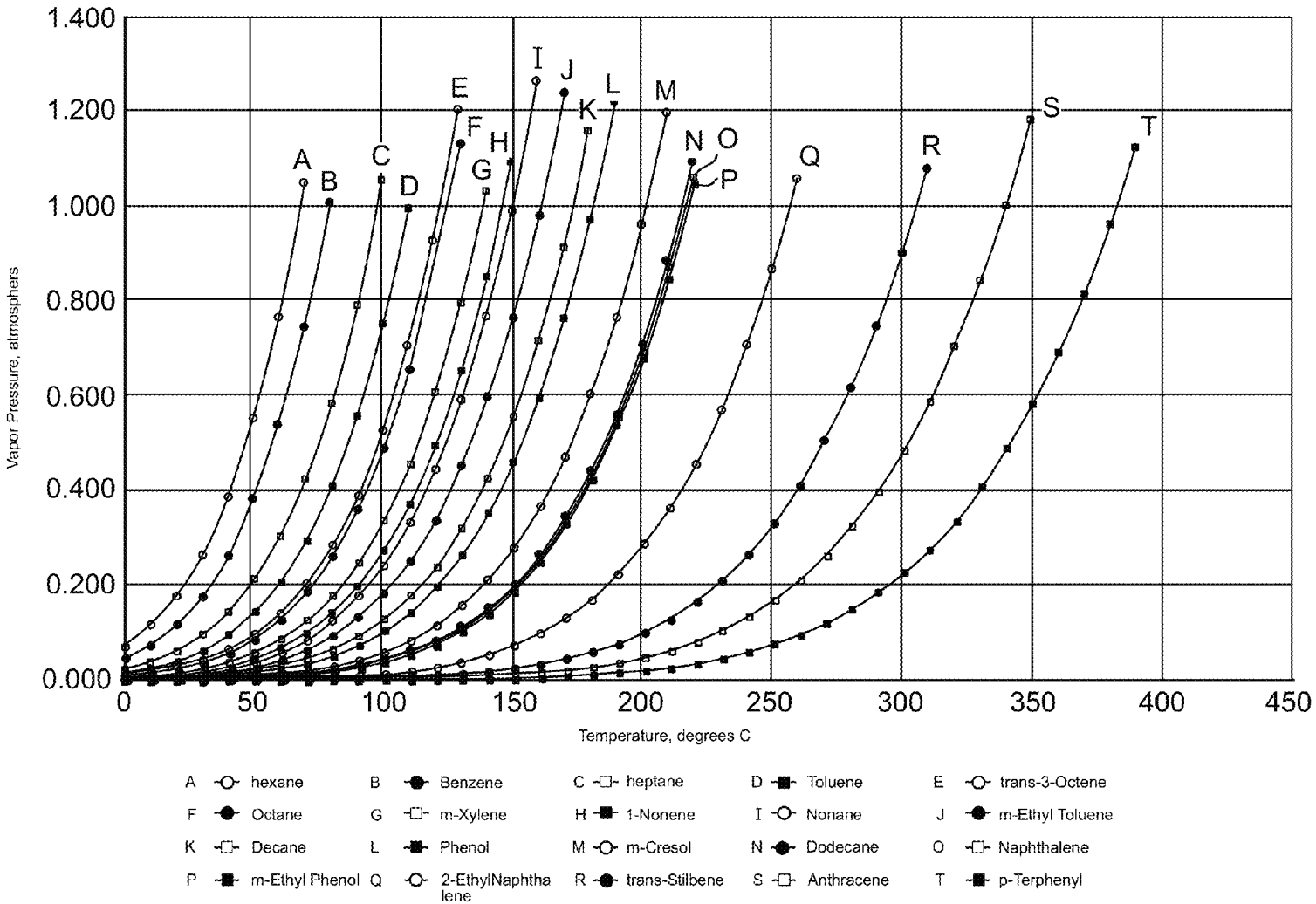
FIG. 3 is a chart showing a series of $C_6$+ hydrocarbon compounds and their equilibrium vapor pressure as a function of temperature.

More specifically, it is known that each CDL component of the hydrocarbon gases has a fractional condensation temperature (FCT) that is a function of the partial pressure or vapor pressure of that compound in a mixture. Since effluent gases from the pyrolysis of coal produces a complex mixture of many compounds, each exerts only a fraction of the approximately 1 atm experienced in the system. FIG. 3 illustrates the relationship between equilibrium vapor (or partial) pressure and temperature for twenty (20) of the most common condensable hydrocarbons present in effluent gases. Notably all are $C_6$ or larger and some are cyclic compounds. Curve M, for example, shows that m-Cresol at 1 atm should condense at about 200 C, but at only 0.2 atm, would condense at about 140 C. Other compounds similarly have FCTs that are reduced from their BPs depending on their fractional concentration, as shown in FIG. 3.

From the blending area, the coal char, coal fines, and particulates removed from the various CDL fraction may all be blended together to form fuel pellets or briquettes. In some embodiments, a portion of the heavy CDL fraction may optionally be used as a binder for the briquettes. Sludge 34 (with or without char fines) may also optionally be used as a binder for the briquettes.

EXAMPLE I

A process and apparatus is set up substantially as schematically described in FIG. 2 except no cyclone or venturi is used. Pyrolysis gas feed of 64,000 lbs/hr (29,030 kg/hr) is established with a breakdown as follows:

15,000 lbs/hr (6,804 kg/hr) condensable components (CDLs);

22,000 lbs/hr (9,979 kg/hr) of a sweep gas used to heat the pyrolysis chamber as described in US2011/0011722 to Rinker;

27,000 lbs/hr (12,247 kg/hr) non-condensable or syngas component.

This produces a condensable partial pressure of about 23.4% (15,000/64,000), i.e. approximately 25%. A three condensation zone absorber is arranged with heat exchange loops maintained at target temperatures of:

about 495F (257C) for the heavy CDL fraction about 300F (149C) for the middle CDL fraction, and about 170F (77C) for the light CDL fraction.

This configuration is designed to produce respective fractions of about 20% heavy, 25% middle and 55% light, with about 20% of the light being condensed in the exchange loop and an additional 35% recovered from an entrained mist in the air stream by an electrostatic precipitator in the gas cleaning area.

EXAMPLE II

A process and apparatus substantially as schematically described in FIG. 2 is set up. Seventeen process sampling points designated by Roman numerals from I to XVII are monitored and produce the data from Table B, below. A pyrolysis effluent gas feed of 41,813 kg/hr is delivered to a cyclone at about 473 C, which removes about 4655 kg/hr of particulates or about 11% by weight, leaving 37,158 kg/hr to flow into the absorber. Various fractions of CDLs (a combined total of 8,082 kg/hr) are removed at temperatures as shown in the Table B. Of this, about 24% is heavy CDL from zone A, about 30% is medium CDL from zone B, and about 25% from Zone C plus another 22% from the electrostatic precipitator totals about 47% light CDLs. This leaves about 27,409 kg/hr in non-condensable gases. The noncondensable gas stream is split, with approximately ⅔ (17,988 kg/hr) returning to the pyrolysis area as a sweep gas, and about ⅓ (9,424 kg/hr) being cooled to remove water and stored and/or supplied as a dried gaseous fuel. The characteristics of a gaseous fuel from a similar experiment with different flow rates are given in Table C below. Of course, the flow rates, volumes, capacities and the like are merely examples of the capabilities of the invention. Moreover, the gaseous fuel produced in this manner has a high heating value, for example in excess of 8000 BTU/lb. As seen from Table C, 124,000,000 BTU/hr divided by 15,044 lb/hr gives a fuel heating value of 8,241 BTU/lb (or 21.05 MJ/kg).

TABLE B

FRACTIONATING COMPONENTS FROM A PYROLYSIS GAS STREAM

| | I Pyrolysis Gas To Cyclone | II Pyrolysis Gas To Venturi | III Dust out from Cyclone | IV Gas into Zone A | V Heavy Oil Fraction Out | VI Gas into Zone B | VII Medium Oil Fraction Out | VIII Gas into Zone C | IX Light Oil Fraction Out | X Gas into ESP |
|---|---|---|---|---|---|---|---|---|---|---|
| T (° C.): | 473 | 473 | 473 | 400 | 273 | ~170 | 150 | 100 | 72 | 77 |
| Moisture: | 24% | 27% | | 27% | | 29% | 43% | 27% | | 30% |
| Flow: | kg/hr | kg/hr | kg/hr | kg/hr | kg/hr | kg/hr | kg/hr | kg/hr | kg/hr | kg/hr |
| $H_2$ | 172 | 172 | | 172 | | 172 | | 172 | | 172 |
| $CO_2$ | 8931 | 8931 | | 8931 | | 8931 | | 8931 | | 8931 |
| $H_2O$ | 9990 | 9990 | | 9990 | | 9990 | 1250 | 8740 | | 8740 |
| CO | 2954 | 2954 | | 2954 | | 2954 | | 2954 | | 2954 |
| $CH_4$ | 2750 | 2750 | | 2750 | | 2750 | | 2750 | | 2750 |
| $C_2H_6$ | 925 | 925 | | 925 | | 925 | | 925 | | 925 |
| $C_2H_4$ | 281 | 281 | | 281 | | 281 | | 281 | | 281 |

TABLE B-continued

FRACTIONATING COMPONENTS FROM A PYROLYSIS GAS STREAM

| | | | | | | | | | | |
|---|---|---|---|---|---|---|---|---|---|---|
| $C_3H_8$ | 498 | 498 | | 498 | | 498 | | 498 | | 498 |
| $C_3H_6$ | 415 | 415 | | 415 | | 415 | | 415 | | 415 |
| $C_4H_{10}$ | 201 | 201 | | 201 | | 201 | | 201 | | 201 |
| $C_4H_8$ | 313 | 313 | | 313 | | 313 | | 313 | | 313 |
| $C_4H_6$ | 5 | 5 | | 5 | | 5 | | 5 | | 5 |
| $C_5H_{12}$ | 148 | 148 | | 148 | | 148 | | 148 | | 148 |
| $C_5H_{10}$ | 170 | 170 | | 170 | | 170 | | 170 | | 170 |
| $C_6^+$ | 848 | 848 | | 848 | | 848 | | 848 | | 848 |
| S | 58 | 58 | | 58 | | 58 | | 58 | | 58 |
| CARBON | 5072 | 417 | 4655 | 417 | 417 | | | | | |
| OIL | 8082 | 8082 | | 8082 | 1975 | 6207 | 1675 | 4532 | 2406 | 2126 |
| Total | 41,813 | 37,158 | 4655 | 37,158 | 2292 | 34,866 | 2925 | 31,941 | 2406 | 29,535 |

| | XI ESP Oil Fraction Out | XII Total Light Oil Fraction Out | XIII Total Wet Gas From ESP | XIV Sweep Gas to Pyrolysis | XV Wet Gas to Coder | XVI Condensed Water | XVII Net Dry Gas |
|---|---|---|---|---|---|---|---|
| T (° C.): | 77 | 74 | 77 | 77 | 77 | 50 | 60 |
| Moisture: | | | 32% | 31% | 35% | 100% | 10% |
| Flow: | kg/hr | kg/hr | kg/hr | kg/hr | kg/hr | kg/hr | kg/hr |
| $H_2$ | | | 172 | 115 | 57 | | 57 |
| $CO_2$ | | | 8931 | 5968 | 2963 | | 2963 |
| $H_2O$ | | | 8740 | 5488 | 3255 | 2600 | 855 |
| CO | | | 2954 | 1980 | 974 | | 974 |
| $CH_4$ | | | 2750 | 1840 | 910 | | 910 |
| $C_2H_6$ | | | 925 | 620 | 305 | | 305 |
| $C_2H_4$ | | | 281 | 190 | 91 | | 91 |
| $C_3H_8$ | | | 498 | 335 | 163 | | 163 |
| $C_3H_6$ | | | 415 | 280 | 135 | | 135 |
| $C_4H_{10}$ | | | 201 | 135 | 66 | | 66 |
| $C_4H_8$ | | | 313 | 210 | 103 | | 103 |
| $C_4H_6$ | | | 5 | 3 | 2 | | 2 |
| $C_5H_{12}$ | | | 148 | 100 | 48 | | 48 |
| $C_5H_{10}$ | | | 170 | 115 | 55 | | 55 |
| $C_6^+$ | | | 848 | 570 | 278 | | 278 |
| S | | | 58 | 39 | 19 | | 19 |
| CARBON | | | | | | | |
| OIL | 2126 | 4532 | | | | | |
| Total | 2126 | 4532 | 27409 | 17,968 | 9424 | 2600 | 6824 |

40

TABLE C

GASEOUS FUEL CHARACTERISTICS

| Component: | | Composition (Mass %) | Mass Flow (lb/hr) | Mass Flow (kg/hr) | Higher Heating Value (Btu/lb) | Higher Heating Value (MM BTU/hr) | MW |
|---|---|---|---|---|---|---|---|
| Hydrogen | $H_2$ | 0.84% | 126 | 57 | 61,100 | 7.68 | 2.25 |
| Carbon Dioxide | $CO_2$ | 43.42% | 6532 | 2963 | | | |
| Water Vapor | $H_2O$ | 9.60% | 1444 | 655 | | | |
| Carbon Monoxide | CO | 14.27% | 2147 | 974 | 4,347 | 9.33 | 2.74 |
| Methane | $CH_4$ | 13.34% | 2006 | 910 | 23,879 | 47.91 | 14.04 |
| Ethane | $C_2H_6$ | 4.47% | 672 | 305 | 22,320 | 15.01 | 4.40 |
| Ethylene | $C_2H_4$ | 1.33% | 201 | 91 | 21,644 | 4.34 | 1.27 |
| Propane | $C_3H_8$ | 2.39% | 359 | 163 | 21,661 | 7.78 | 2.28 |
| Propylene | $C_3H_6$ | 1.98% | 298 | 135 | 21,041 | 6.26 | 1.84 |
| Butane | $C_4H_{10}$ | 0.97% | 146 | 66 | 21,308 | 3.10 | 0.91 |
| Butene | $C_4H_8$ | 1.51% | 227 | 103 | 20,840 | 4.73 | 1.39 |
| Butadiene | $C_4H_6$ | 0.03% | 4 | 2 | 20,635 | 0.09 | 0.03 |
| Iso Pentane | $C_5H_{12}$ | 0.70% | 106 | 48 | 21,052 | 2.23 | 0.65 |
| Pentene | $C_5H_{10}$ | 0.81% | 121 | 55 | 20,712 | 2.51 | 0.74 |
| | $C_6^+$ | 4.07% | 613 | 278 | 20,940 | 12.83 | 3.76 |
| Sulfur | S | 0.28% | 42 | 19 | 3,983 | 0.17 | 0.05 |
| Total | | 100.0% | 15,044 | 6824 | | 124 | 36 |

65

While the invention has been described with reference to various and preferred embodiments, it should be understood by those skilled in the art that various changes may be made and equivalents may be substituted for elements thereof without departing from the essential scope of the invention. In addition, many modifications may be made to adapt a particular situation or material to the teachings of the invention without departing from the essential scope thereof.

Therefore, it is intended that the invention not be limited to the particular embodiment disclosed herein contemplated for carrying out this invention, but that the invention will include all embodiments falling within the scope of the claims.

What is claimed is:

1. A method treating effluent gases evolved from a coal pyrolysis process to recover condensable coal-derived liquids, the method comprising passing the evolved gases through a cyclone separator;

passing the evolved gases from the cyclone separator through a venturi having an outlet directed downwardly into a multizone absorber;

passing the evolved gases through at least two sequential condensation zones of the multizone absorber, each zone being maintained at a different temperature to condense to liquids the different boiling point fractions of the evolved gases, wherein the temperature of each sequential condensing zone is controlled within a predetermined, sequentially cooler temperature range by a heat exchanger to collect a desired CDL fraction; and directing the condensed liquids from each condensation zone to its own separate storage tank, optionally via a separation unit to remove particulate sludge;

further comprising at least three condensation zones, for heavy (high BP), medium and light (low BP) CDL fractions, and wherein the predetermined temperature ranges for the three condensation zones are, sequentially, from about 450° F. (232° C.) to about 550° F. (288° C.) for the heavy CDL fraction, from about 250° F. (121° C.) to about 400° F. (204° C.) for the medium CDL fraction, and from about 150° F. (65° C.) to about 250° F. (121° C.) for the light CDL fraction.

2. The method of claim 1 further comprising maintaining the venturi at a high temperature of from about 350° C. to about 500° C.

3. The method of claim 2 further comprising introducing a heating or cooling fluid to the venturi to mix and wet the effluent gases and to form droplets that serve as nucleation sites for the heavy (high BP) fraction.

4. A method for treating effluent gases evolved from a coal pyrolysis process, the method comprising passing the evolved gases through a cyclone separator;

passing the evolved gases from the cyclone separator through a venturi having an outlet directed downwardly into a multizone absorber;

passing the evolved gases through at least two distinct condensation zones of the multizone absorber, each zone being maintained at a different temperature to condense to liquids the different boiling point fractions of the evolved gases;

optionally directing the liquids from each condensation zone to one or more separation units to separate particulate sludge and/or impurities from the condensed liquids; and directing the condensed liquids from each separation unit to its own separate storage tank, wherein the temperature of each condensing zone is controlled within a predetermined temperature range to collect a desired CDL fraction in each of the storage tanks, and further comprising bleeding bottom particulates from a heavy CDL fraction condensation zone and combining these with the sludge and coal char in a blending area.

5. The method of claim 4 further comprising briquetting the blended coal char and separated sludge into fuel briquettes.

6. The method of claim 5 further comprising using a portion of the heavy CDL fraction as binder for the briquettes.

7. A method for recovering condensable coal-derived liquids from gases evolved from a coal pyrolysis process, the method comprising passing the evolved gases through a high temperature cyclone separator;

passing the evolved gases from the cyclone separator through a venturi into a multizone absorber having at least a first condensation zone maintained at a first temperature range, and a second condensation zone maintained at a second temperature range, the first temperature range being higher than the second temperature range to define the first condensation zone as a high BP condensation zone relative to the second condensation zone as a low BP condensation zone, thereby condensing to liquids different boiling point fractions of the evolved gases in the different condensation zones; and separately collecting the condensed liquids from each condensation zone, optionally via a separation unit to remove particulate sludge;

wherein the venturi includes an outlet directed downwardly into the first zone of the absorber and the venturi is maintained at a high temperature relative to the first temperature range.

8. The method of claim 7 wherein the multizone absorber further comprises at least a third condensation zone intermediate the first and second condensation zones, the third condensation zone being maintained at a third temperature range intermediate the first temperature range and the second temperature range to define a medium BP condensation zone.

9. The method of claim 8 wherein the temperature ranges for the three condensation zones are from about 450° F. (232° C.) to about 550° F. (288° C.) for the high BP condensation zone, from about 250° F. (121° C.) to about 400° F. (204° C.) for the medium BP condensation zone, and from about 150° F. (65° C.) to about 250° F. (121° C.) for the low BP condensation zone.

10. The method of claim 7 further comprising maintaining the venturi at a high temperature of from about 350° C. to about 500° C.

11. The method of claim 10 further comprising introducing a heating or cooling fluid to the venturi to mix and wet the effluent gases and to form droplets that serve as nucleation sites for condensation of the high BP fraction to form high BP nuclei.

12. The method of claim 11, further comprising removing the high BP nuclei in the high BP condensation zone, as a result of the high temperature, downwardly-directed venturi, while lower BP fractions remain vaporous.

13. The method of claim 7, further comprising heating or cooling the heating or cooling fluid by means of heat exchangers to maintain the heating or cooling fluid introduced to the venturi at a temperature from about 350° C. to about 500° C. to provide high BP nucleation sites for condensation and coalescence of the high BP fraction while lower BP fractions remain vaporous; and collecting the high BP nucleation sites in the high BP condensation zone, thereby preventing them from continuing upward to the low BP condensation zone.

14. The method of claim 7, further comprising reducing particle load to less than 1% in the evolved gases passing into the absorber from the venturi.

15. The method of claim 7, wherein evolved gases passing into the multizone absorber from the venturi have minus 5 micron particulate loads of not more than about 5%.

16. The method of claim 7, further comprising retaining in the heavy (high BP) CDL fraction up to 95% of the char fines and quinoline insoluble particulates.

17. The method of claim 7, further comprising selecting at least the first temperature range and the second temperature range, and optionally any intermediate temperature ranges for the condensation zones, by determining a fractional condensation temperature for each condensation zone, the fractional condensation temperature being based on the composition of the evolved gases, the fraction of condensable components in the evolved gases, and the number of condensation zones.

18. The method of claim 7, wherein the gases evolved from the low BP condensation zone are further processed by an electrostatic precipitator to remove mist particulates of light oils.

19. The method of claim 17, wherein at least a portion of the noncondensable gases evolved from the electrostatic precipitator are recycled to the pyrolysis chamber as a sweep gas.

20. The method of claim 17, further comprising cooling at least a portion the gases from the electrostatic precipitator to condense and remove water vapor present to form a dried gaseous fuel.

* * * * *